US008893435B2

(12) United States Patent
Nicholson

(10) Patent No.: US 8,893,435 B2
(45) Date of Patent: Nov. 25, 2014

(54) METHOD AND APPARATUS FOR A MOVABLE BARRIER OPERATOR HAVING A MOTOR AND A REDUCTION MECHANISM DISPOSED PARALLEL TO AND LATERALLY THEREOF

(75) Inventor: Scott James Nicholson, Green Point (AU)

(73) Assignee: Chamberlain Australia Pty Ltd., Lake Cove NSW (AU)

( * ) Notice: Subject to any disclaimer, the term of this patent is extended or adjusted under 35 U.S.C. 154(b) by 1875 days.

(21) Appl. No.: 12/169,282

(22) Filed: Jul. 8, 2008

(65) Prior Publication Data

US 2010/0005724 A1 Jan. 14, 2010

(51) Int. Cl.
*E05F 11/00* (2006.01)

(52) U.S. Cl.
USPC ..... 49/199; 49/139

(58) Field of Classification Search
USPC ..... 49/197, 199, 139, 140
See application file for complete search history.

(56) References Cited

U.S. PATENT DOCUMENTS

| | | | | |
|---|---|---|---|---|
| 2,670,065 | A * | 2/1954 | Stevens, Jr. | 192/18 R |
| 3,045,164 | A * | 7/1962 | Russell | 318/266 |
| 3,512,302 | A * | 5/1970 | Kapik et al. | 49/139 |
| 3,996,697 | A * | 12/1976 | Bailey et al. | 49/28 |
| 4,493,223 | A * | 1/1985 | Kishi et al. | 74/371 |
| 4,786,156 | A * | 11/1988 | Kotani et al. | 359/872 |
| 5,581,939 | A * | 12/1996 | Regan et al. | 49/139 |
| 5,839,555 | A * | 11/1998 | Hsieh | 192/223.1 |
| 5,881,497 | A * | 3/1999 | Borgardt | 49/139 |
| 6,029,735 | A * | 2/2000 | Nicholson | 160/321 |
| 6,055,885 | A * | 5/2000 | Shea | 74/625 |
| 6,381,903 | B1 * | 5/2002 | Desrochers et al. | 49/139 |
| 7,040,473 | B2 * | 5/2006 | Schachtl et al. | 192/84.91 |
| 7,055,283 | B2 * | 6/2006 | Hsieh | 49/139 |
| 7,878,230 | B2 * | 2/2011 | Daus et al. | 160/9 |
| 2004/0245064 | A1 * | 12/2004 | Schachtl et al. | 192/84.961 |
| 2005/0172559 | A1 * | 8/2005 | Hsieh | 49/140 |
| 2006/0042762 | A1 * | 3/2006 | Huang | 160/168.1 R |
| 2009/0313898 | A1 * | 12/2009 | Manaras et al. | 49/31 |

FOREIGN PATENT DOCUMENTS

| | | | | |
|---|---|---|---|---|
| WO | WO 9316262 | A1 * | 8/1993 | E05F 15/16 |

OTHER PUBLICATIONS

US Gear Corp. RGH33 Product Specification covering motors for roller shutters, tubular motors, blinds & home DIY products (publication date is at least as early as Apr. 2, 2008.

(Continued)

*Primary Examiner* — Jerry Redman
(74) *Attorney, Agent, or Firm* — Fitch Even Tabin & Flannery LLP

(57) ABSTRACT

A movable barrier operator (200) comprises a motor (201) having an output drive shaft that itself comprises a first end (202) and a second end (203) that is disposed opposite to the first end. The movable barrier operator also comprises a hand-operated chain hoist (204) that is connected to the second end of this output drive shaft. By one approach, the movable barrier operator also comprises a reduction mechanism (207) and a transmission (210). The reduction mechanism is disposed parallel to and laterally of the motor and comprises a movable barrier drive output (208) and an input drive shaft (209). The transmission, in turn, is disposed to couple the first end of the output drive shaft of the motor to the input drive shaft of the reduction mechanism.

7 Claims, 2 Drawing Sheets

(56) References Cited

OTHER PUBLICATIONS http://usgearcorp.com/sp_a/aSGHL%2050.htm; US Gear Product Specification for SGHL 50W Internal Lock Sensors (Mar. 25, 2008).

Information sheet by Cornell relative to M100 Retrofit Fire Door Operators (publication date is at least as early as Apr. 2, 2008.

Australian Patent Application No. 2009202349; Patent Examination Report No. 1 dated Jun. 13, 2014.

* cited by examiner

METHOD AND APPARATUS FOR A MOVABLE BARRIER OPERATOR HAVING A MOTOR AND A REDUCTION MECHANISM DISPOSED PARALLEL TO AND LATERALLY THEREOF

TECHNICAL FIELD

This invention relates generally to movable barrier operators.

BACKGROUND

Movable barrier operators of various kinds are known in the art and include, for example, so-called garage door openers. Movable barrier operators typically serve to facilitate the automated movement of one or more corresponding movable barriers (such as, but not limited to single panel and segmented garage doors, rolling shutters, pivoting and sliding gates, arm guards, and so forth). In many cases such movable barrier operators are responsive to a remotely sourced control signal (or signals) to institute such activity.

Some movable barrier operators (such as some so-called jack shaft operators) make use of in-line helical reduction mechanisms to reduce the output speed provided by the operator motor while increasing the corresponding rotational torque that is available to move the corresponding movable barrier. Such reduction mechanisms, being in-line with the motor, necessitate a relatively lengthy movable barrier operator. This can lead to installation problems when sufficient space to accommodate the combined length of the motor and the reduction mechanism is unavailable.

Many such movable barrier operators also include a hand-operated chain hoist to permit hand-based manipulation of the movable barrier when such is desired. When using an in-line helical reduction mechanism as described above, however, this chain may be necessarily disposed at some lateral distance from the drive mechanism that couples the movable barrier operator to the movable barrier. In some cases, this unfortunately places the chain into the opening of the movable barrier. Such placement can cause various problems and inconveniences and often necessitates storing the chain in, for example, a suspended bag or the like.

BRIEF DESCRIPTION OF THE DRAWINGS

The above needs are at least partially met through provision of the method and apparatus for a movable barrier operator having a motor and a reduction mechanism disposed parallel to and laterally thereof described in the following detailed description, particularly when studied in conjunction with the drawings, wherein.

Figure 1:
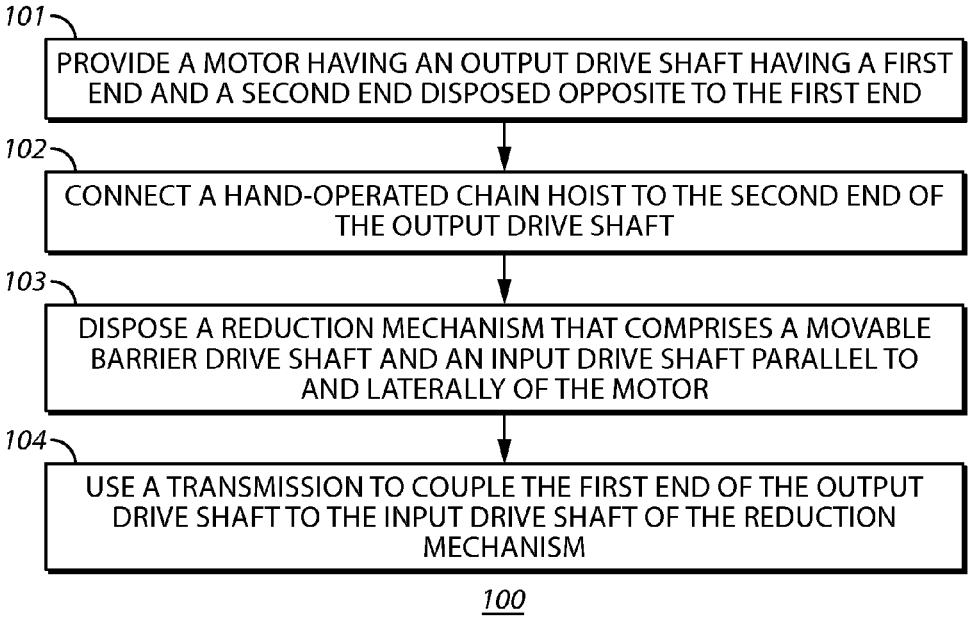
FIG. 1 comprises a flow diagram as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a movable barrier operator comprises a motor having an output drive shaft that itself comprises a first end and a second end that is disposed opposite to the first end. The movable barrier operator also comprises a hand-operated chain hoist that is connected to the second end of this output drive shaft. By one approach, the movable barrier operator also comprises a reduction mechanism and a transmission. The reduction mechanism is disposed parallel to and laterally of the motor and comprises a movable barrier drive shaft and an input drive shaft. The transmission, in turn, is disposed to couple the first end of the output drive shaft of the motor to the input drive shaft of the reduction mechanism.

So configured, the motor and the reduction mechanism essentially occupy a similar (or identical) amount of coextensive in-line space. This, in turn, yields an overall movable barrier operator form factor that is considerably shorter than one expects from the prior art in this regard. It will also be noted and appreciated that such a configuration will facilitate locating the chain for the hand-operated chain hoist such that the latter is essentially coextensive with the drive train that couples the movable barrier drive shaft of the reduction mechanism to the movable barrier itself. As a result, for example, it now becomes possible to dispose the chain in a considerably less inconvenient location (such as at the side of the movable barrier opening rather than within that opening).

These teachings will readily support leveraging available components in many instances to achieve compliant embodiments. It will also be appreciated that these teachings are highly scalable and can be applied in a wide variety of application settings and in conjunction with a wide variety of implementing components.

Figure 2:
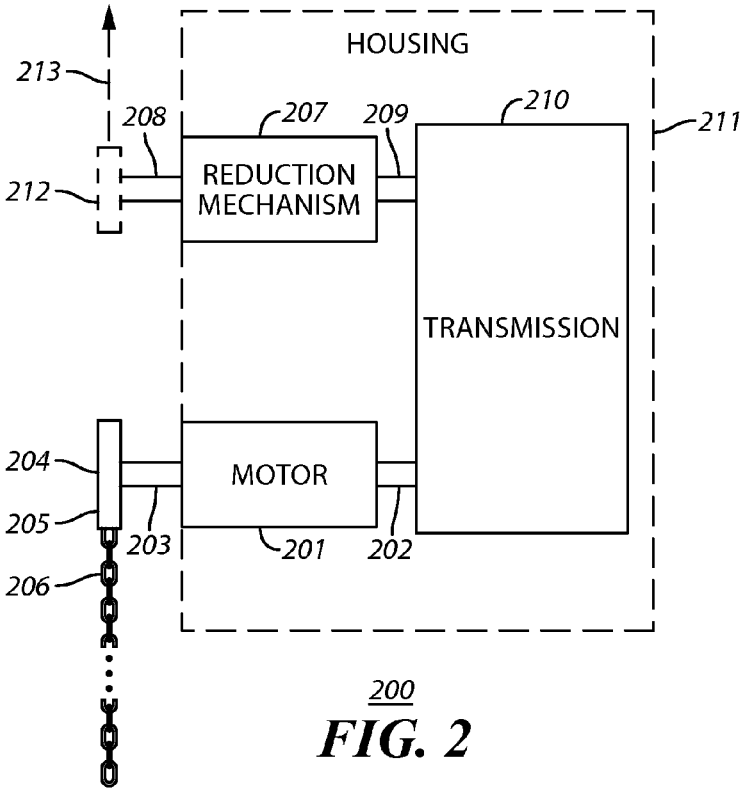
FIG. 2 comprises a block diagram as configured in accordance with various embodiments of the invention.
Figure 3:
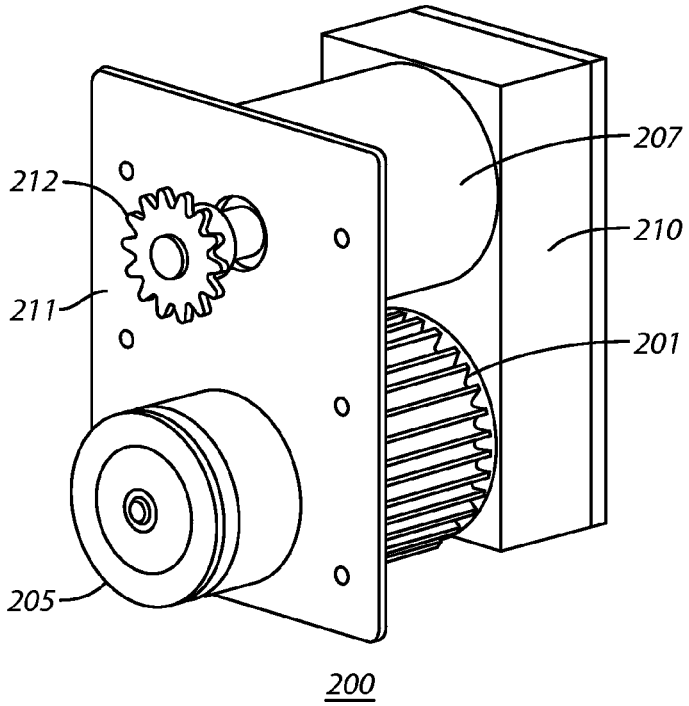
FIG. 3 comprises a perspective detail view as configured in accordance with various embodiments of the invention.

These and other benefits may become clearer upon making a thorough review and study of the following detailed description. Referring now to the drawings, and in particular to FIGS. 1, 2, and 3, an illustrative process that is compatible with many of these teachings will now be presented.

This process 100 has a step 101 that provides a motor 201. This motor 201 has an output drive shaft having a first end 202 and a second end 203 that is disposed opposite to the first end 202. Various motors are known and used in the art to serve as a motive force for movable barrier operators and these teachings are not particularly sensitive to the selection of any particular choice in these regards. Generally speaking, the motor will typically comprise a ¼ to 5 horsepower electric motor (though other possibilities may be considered depending upon the application setting) and can comprise either an AC or a DC motor. Energization of this motor 201 will typically be controlled by control circuitry (not shown) in accordance with well understood prior art practice.

This process 100 also provides the step 102 of connecting a hand-operated chain hoist 204 to the aforementioned second end 203 of the output drive shaft. This hand-operated chain hoist 204 can comprise, for example, a chain pulley wheel 205 and a corresponding chain 206. The chain pulley wheel 205 connects to the second end 203 of the motor's output drive shaft and interacts with the chain 206 such that hand-manipulated movement of the chain 206 will cause corresponding rotation of the chain pulley wheel 205 and hence of the second end 203 of the motor's output drive shaft. This, in turn, can permit an end user to cause selective rotation of the motor's output drive shaft to thereby cause human-powered opening and closing of the corresponding movable barrier.

Another step 103 provides for disposing a reduction mechanism 207 parallel to and laterally of the motor 201. This reduction mechanism 207 includes a movable barrier output drive shaft 208 and an input drive shaft 209. By one approach, this reduction mechanism 207 can comprise, in whole or in part, an epicyclic reduction gear system as is known in the art. So configured, the resultant movable barrier operator 200 can benefit from the higher efficiencies that are associated with such a helical gear-based reduction mechanism. Those skilled in the art will note and appreciate that this laterally-displaced juxtapositioning of this reduction mechanism 207 in parallel with the motor 201 leads directly to a resultant movable barrier operator 200 having a considerably reduced in-line form factor. This, in turn, permits this movable barrier operator 200 to be installed in constrained application settings that would otherwise be unsuitable for a movable barrier operator that includes an epicyclic reduction mechanism.

This process 100 then also includes a step 104 of using a transmission 210 to couple the first end 202 of the motor's output drive shaft to the input drive shaft 209 of the reduction mechanism 207. Given the aforementioned orientation of the motor 201 to the reduction mechanism 207, in many cases this will comprise disposing the transmission 210 substantially perpendicular to, for example, the motor 201. Generally speaking, the purpose of this transmission 210 is to couple the rotational driving force of the motor 201 to the input of the reduction mechanism 207. Various transmission mechanisms and approaches are known in the art and these teachings are not particularly sensitive in this regard. The transmission can comprise, for example, but is not limited to, a chain, belt, or gear system.

Figure 4:
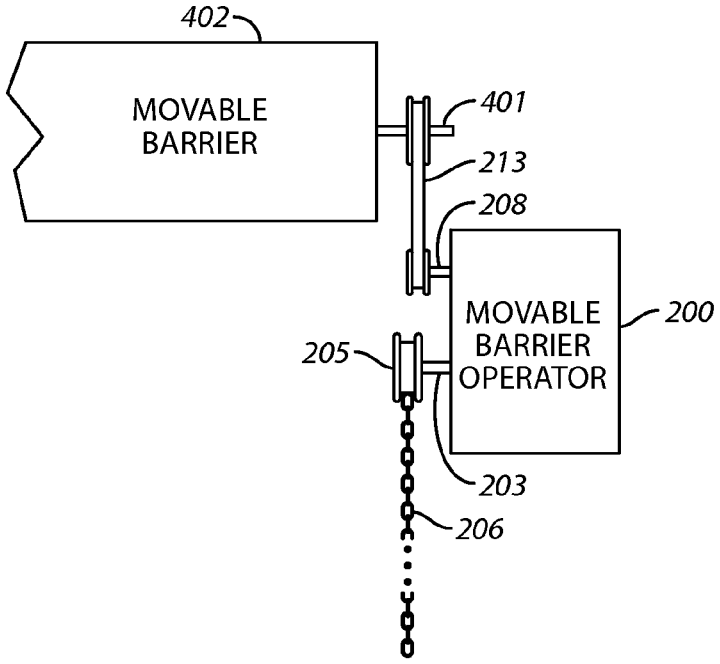
FIG. 4 comprises a schematic view as configured in accordance with various embodiments of the invention.

By one approach, the movable barrier output drive shaft 208 can connect to a sprocket 212. This sprocket 212, in turn, can interface with a drive train linkage 213 (such as a chain, belt, or the like) that interacts with and drives an axle 401 (as shown in FIG. 4) as comprises a part of the corresponding movable barrier 402 (such as a rolling shutter-styled movable barrier).

By one approach, and as illustrated, the motor 201 and the reduction mechanism 207 are disposed such that the movable barrier output drive shaft 208 and the hand-operated chain hoist 204 are both located on a same side of the movable barrier operator 200. By one approach, this can comprise, at least in part, mounting both the motor 201 and the reduction mechanism 207 (either directly or indirectly) to a common surface of, for example, an optionally-provided housing 211 for the movable barrier operator 200. This might comprise, for example, using a same side of the housing 211 to support, at least in part, these components. So configured, by one approach, the second end 203 of the motor's output drive shaft and the reduction mechanism's movable barrier output drive shaft 208 can both extend outwardly of such a housing 211 on a same side thereof.

In such a case, the hand-operated chain hoist 204 and the sprocket 212 will both be located on a same side of the movable barrier operator 200 as well. As illustrated, this orientation can permit, if desired, the drive train linkage 213 and the chain 206 to be substantially vertically aligned with one another. This alignment can be relatively exact, if desired, or within some range of allowed horizontal displacement such as within one inch, two inches, five inches, or the like of one another. Those skilled in the art will recognize and appreciate that this, in turn, provides great flexibility with respect to permitting the chain 206 to be disposed at the side of a movable barrier's opening rather than far to the side or within the opening itself. This, in turn, can aid in placing the chain 206 in a more convenient and intuitive location.

So configured, these teachings are able to greatly leverage available components in a manner that facilitates their use and application in a form factor that is considerably more friendly to the constraints of many application settings. These teachings are also easily scaled to accommodate a wide variety of application setting needs and requirements. Notwithstanding such improved installation circumstances, these teachings also offer an opportunity for greatly improved accommodation of hand-operated chain hoist capabilities. It will be further recognized and appreciated that these benefits are attained in an economical manner.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

I claim:

1. A movable barrier operator comprising:

a motor having a central longitudinal axis defined along an output drive shaft, the output drive shaft comprising a first end disposed on a first side of the motor and a second end disposed opposite to the first end on a second side of the motor opposite the first side of the motor, the motor further having a longitudinal length extending between the first side and the second side of the motor;

a hand-operated chain hoist connected to the second end of the output drive shaft;

a reduction mechanism having a longitudinal length extending between opposing sides thereof, the reduction mechanism further having a central longitudinal axis defined along a movable barrier drive shaft of the reduction mechanism, the central longitudinal axis of the reduction mechanism configured to be disposed substantially parallel to and lateral of the central longitudinal axis of the motor, the longitudinal length of the reduction mechanism further being configured to at least partially overlap and be disposed lateral to the longitudinal length of the motor, the reduction mechanism further comprising an input drive shaft;

a transmission disposed to couple the first end of the output drive shaft of the motor to the input drive shaft of the reduction mechanism.

2. The movable barrier operator of claim 1 wherein the transmission is disposed substantially perpendicular to the motor.

3. The movable barrier operator of claim 2 wherein the reduction mechanism and the motor are mounted to at least one common surface.

4. The movable barrier operator of claim 3 further comprising:

a housing, wherein the housing has a side thereof that comprises the common surface.

5. The movable barrier operator of claim 1 wherein the reduction mechanism comprises an epicyclic reduction gear system.

6. The movable barrier operator of claim 1 wherein the hand-operated chain hoist and the movable barrier drive shaft are both disposed on a same side of the movable barrier operator.

7. The movable barrier operator of claim 1 further comprising:

a sprocket that is mounted on the movable barrier drive shaft.

* * * * *